United States Patent [19]

Lemburg et al.

[11] Patent Number: 4,458,674

[45] Date of Patent: Jul. 10, 1984

[54] TRANSPORT INCUBATOR

[75] Inventors: Peter Lemburg, Kaarst; Horst Frankenberger, Bad Schwartau; Eberhard Bohn; Wolfgang Franz, both of Lübeck, all of Fed. Rep. of Germany

[73] Assignee: Drägerwerk A.G., Fed. Rep. of Germany

[21] Appl. No.: 376,187

[22] Filed: May 7, 1982

[30] Foreign Application Priority Data

May 14, 1981 [DE] Fed. Rep. of Germany ..... 3119213

[51] Int. Cl.[3] ..... A61G 11/00

[52] U.S. Cl. ..... 128/1 B; 119/15; 119/35

[58] Field of Search ..... 119/37, 16, 18, 15, 119/40, 34, 35; 219/399, 400; 128/1 B

[56] References Cited

U.S. PATENT DOCUMENTS

| | | | |
|---|---|---|---|
| 1,022,824 | 4/1912 | Byce | 119/40 |
| 2,056,865 | 10/1936 | Owens | 119/18 |
| 2,188,017 | 1/1940 | Schlottmann | 119/34 |
| 3,162,753 | 12/1964 | Boyer | 219/399 |
| 3,557,756 | 1/1971 | Ramsey | 119/15 |
| 3,584,927 | 6/1971 | Ott et al. | 119/37 X |
| 4,141,320 | 2/1979 | Hatfield | 119/37 |

*Primary Examiner*—Hugh R. Chamblee

*Attorney, Agent, or Firm*—McGlew and Tuttle

[57] ABSTRACT

A transport container particularly for use as an incubator comprises a housing having an interior substantially vertical wall and a substantially horizontal wall with a support structure mounted in the housing spaced from the vertical wall and the horizontal wall so as to define a convection passage below and on one side of the support. The convection passage contains means for suspending one or more heating elements in the passage. The heating elements may comprise of preheatable plates, water containers, etc. or each storage material, for example salts or other substances which change in structure when passing through a critical point so as to provide a latent heat for aiding and heating the area overlying the support structure.

4 Claims, 1 Drawing Figure

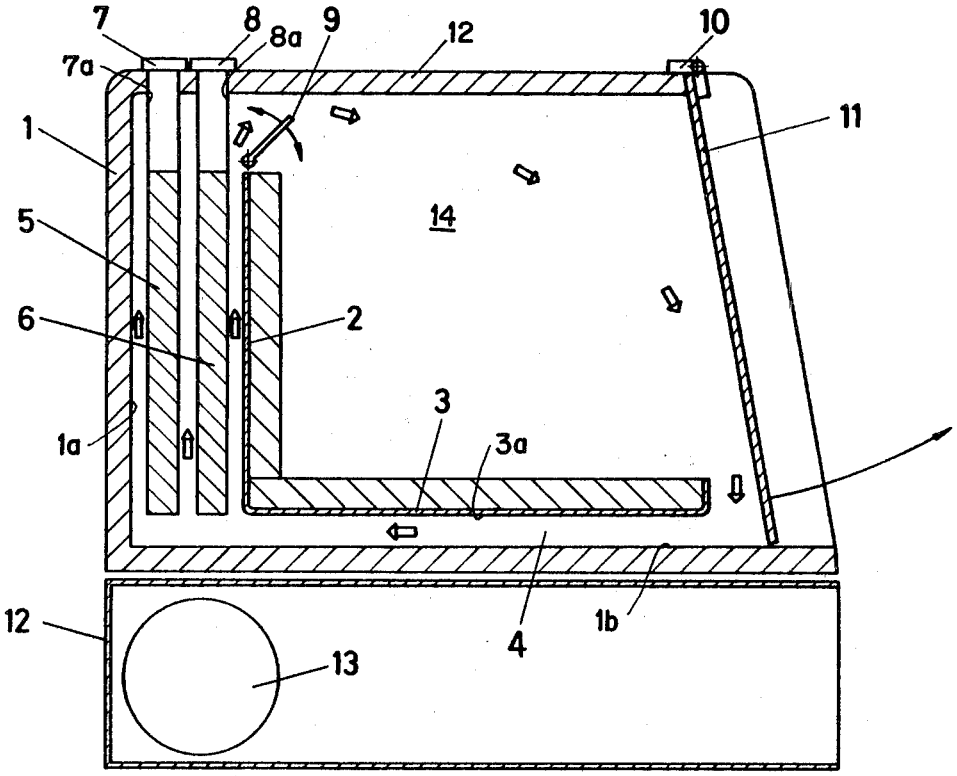
7
8
8a
9
12
10
7a
1
11
14
5
6
2
3
3a
1a
12
13
4
1b

TRANSPORT INCUBATOR

FIELD AND BACKGROUND OF THE INVENTION

The invention relates in general to transport containers and in particular to a new and useful transport incubator whose interior can be heated selectively by different heating elements, including heating elements which are independent of the current supply.

In the transportation of newborns under extreme environmental conditions, an incubator is required which can be used both in transportation and in stationary operation and which can be operated selectively with different heating energies depending on the given conditions.

From German utility model No. 1,704,128 is already known, a transport incubator where heating elements can be fed from a power supply or from the battery of a motor vehicle, as well as hot water bottles under a support of the incubator can also be used as heating elements which are independent of the current supply.

German Pat. Nos. 2,241,937 and 2,300,573 describe transport incubators which contain, in addition to the electrical heating system, heating elements with preheatable heat storage which give off heat when the electrical heating system is turned off, partly by varying the state of aggregation. In the standby position, the electrical heating system can be so regulated by a thermostat that the temperature of the heat storage is above the melting temperature of its filling. When the current supply is cut off, the temperature of the liquid heat storage drops at first until the solidification point is reached, and when passing over into the solid state of aggregation, the heat of solidification is released for heating.

The known embodiments of the transport incubators are not sufficiently adaptable regarding the usability of the various type of heating, which are determined by the environmental conditions and the condition of the newborn. In particular there are difficulties when the transport incubator must be used without current supply connections.

SUMMARY OF THE INVENTION

The invention provides a transport incubator which is readily applicable by using heating elements which are adapted to the existing energy sources. For the solution of this problem the heating elements selected according to the desired type of heating are inserted into a convection channel formed inside the casing. Optimum operating conditions are ensured by the fact that the heating elements, which are substantially identical in their dimensions, can be inserted into the incubator in any desired combination or number.

Since air circulation, and thus heat transfer without current supply connection can only be maintained by natural convection, the accommodation of the heating elements in the convection channel formed inside the casing, which is preferably designed as an interval between the support or rear wall surface and the inner wall of the casing, is of particular importance. The convection flow will heat the air passing over the heating elements. The convection ensures thorough mixing of the heated air without major temperature differences in the resting area of the infant.

For immediate heating and without a power supply connection a water pack can be used. In addition, an exchangeable pack of heating elements with heat storages can be used which, by utilizing the heat of solidification, gives off heat longer than water. In the operation with power supply connection, the electrical heating elements can be used for heating the heat storage materials. At least one heating element is preferably designed as a plug-in electrical heater with current supply connection.

In the advantageous arrangement, where the heating elements are heat exchangers fed with hot water, partial use as a cooling element can preferably also be provided. In the same manner, the heating elements with preheatable heat storage can also be used as a precoolable cooling element.

A particularly advantageous design can provide temperature control in connection with the convection channel in this way that an adjustable throttle valve is provided. Setting of the throttle aperture determines the rate of flow and thus the amount of heat given off by the heating element to the surrounding circulating air. Such a temperature control is particularly advisable in the power independent operation with heating packs and heat storages, because a major temperature drop can be avoided within a longer operating period by varying the throttle aperture.

Accordingly, it is an object of the invention to provide a transport container which includes a support structure in the interior of the housing for carrying an infant, for example and which includes a convection passage defined in the housing around a support structure with the circulation of a temperature control gas or air and which defines a space for accommodating heating elements or temperature control elements which condition the air or gas which is circulated by convection through the container.

A further object of the invention is to provide a transport container which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

The only FIGURE of the drawing is a transverse sectional view of a transport incubator constructed in accordance with the invention.

DESCRIPTION OF THE PREFERRED EMBODIMENT

Referring to the drawing, in particular the invention embodied therein comprises a transport container particularly for use as an incubator which includes a housing 1 which has an interior substantially vertical wall 1*a* and a substantially horizontal wall 1*b*. A support structure 3 is positioned in the housing by supports (not shown) so that it is spaced above the horizontal wall 1*b* and away from the vertical wall 1*a* and defines a convection passage 4 therein for the circulation of a gas or air for controlling the temperature in a space 14 which is located above the support 3. In accordance with the invention means are provided such as access opening 7*a* and 8*a* which permits support of one or more heating elements or temperature control elements 5 through 8. The heating elements or temperature control elements are advantageously such that they may be inserted into or removed from the convection passage as desired and they may be recharged that is reheated for the materials therein may be reconditioned before they are placed back into the space.

Housing or casing 1 has its inner wall 1*a* spaced from an incubator chamber rear wall 2 of a support 3. A convection channel 4 is formed between a bottom wall 3*a* of the support and bottom wall 1*b* and rear wall 2 in which are inserted tubular heating elements 5 and 6, which have each flange-type rim mounts 7 and 8. The channel 4 has a vertical portion between walls 1*a*, 2 and on the outlet side (top) of the convection channel 4 is provided an adjustable throttle valve 9 whose setting can be varied by hand, but also, if necessary, automatically by a regulator, depending on the desired inside temperature. On the front side of casing 1 is provided an apertured flap 11 articulated in a hinge 10. Underneath casing 1 is provided an auxiliary casing 12, which can be attached selectively and which contains e.g. an oxygen bottle 13 and part of the emergency equipment.

The tubular power independent heating elements 5 and 6 advantageously comprise e.g. a pack arrangement of several identical heating elements, or plate shaped heating elements with battery or a power supply connection or corresponding plate shaped heat exchangers to receive a heating or cooling medium, or for the passage of a heating or cooling medium.

For the transportation of twins, a facility for accommodating a second newborn can be preferably provided by engaging an additional resting surface above the first and an upper cover surface 12 inside the incubator.

For the exchangeability and combination of the heating elements, the following variation possibilities are particularly expedient.

1. Power supply independent heating elements with preheated water and heat storage materials, if necessary, by utilization of the heat of solidification (transportation).

2. Power supply independent heating elements only filled with water (transportation).

3. Water with heat exchangers in flow-through (stationary; heating or cooling).

4. Exclusively heat storage elements, if necessary, by utilizing the heat of solidification (long time transportation/long distance transportation.

5. Electrical heating 220/110 V, if necessary combined with heat storage (stationary or transportation).

While a specific embodiment of the invention has been shown and described in detail to illustrate the application of the principles of the invention, it will be understood that the invention may be embodied otherwise without departing from such principles.

What is claimed is:

1. A transport container for use as an incubator comprising:

a housing having a substantially vertical wall, an opposite wall opposite said vertical wall, a top wall and a bottom substantially horizontal wall;

a support structure mounted in said housing having a bottom part spaced above said horizontal wall and a side part spaced away from said vertical wall and defining a convection passage between said support structure and said horizontal and said vertical walls, said convection passage having a vertical portion between said vertical wall and said side part;

said housing defining an incubator space above said bottom part of said support structure and on a side of said side part away from said vertical portion of said convection passage;

a top edge of said side part spaced from said top wall for defining an outlet from said convection passage and an edge of said bottom part opposite said side part spaced away from said opposite wall for defining an inlet to said convection passage for permitting circulation of air from said convection passage to said incubator space and back to said convection passage; and a temperature control heat strorage element removably extending through an opening in said top wall and supported from said top wall, said heat storage element extending into said vertical portion of said convection passage and substantially the entire height of said vertical portion between said housing vertical wall and said support structure side part.

2. A transport container according to claim 1, including throttle means in said outlet and between said convection passage and said incubator space for regulating the flow therebetween by convection.

3. A transport container according to claim 1, wherein a plurality of heating elements are supported on said top wall and extend into said convection passage, said a wall being opposite said vertical wall for hinged to said top wall permitting opening and closing of said incubator space.

4. A transport container according to claim 3, including a separate container connectable to said bottom wall and adapted to contain a breathing gas.

* * * * *